US007518530B2

(12) United States Patent
Ohno et al.

(10) Patent No.: US 7,518,530 B2
(45) Date of Patent: Apr. 14, 2009

(54) METHOD AND SYSTEM FOR BROADCASTING AUDIO AND VISUAL DISPLAY MESSAGES TO A VEHICLE

(75) Inventors: Tsuneo Ohno, Haga-machi (JP); Masayuki Habaguchi, Rolling Hills Estates, CA (US)

(73) Assignee: Honda Motor Co., Ltd., Tokyo (JP)

( * ) Notice: Subject to any disclaimer, the term of this patent is extended or adjusted under 35 U.S.C. 154(b) by 162 days.

(21) Appl. No.: 11/185,517

(22) Filed: Jul. 19, 2005

(65) Prior Publication Data

US 2006/0028323 A1 Feb. 9, 2006

Related U.S. Application Data

(60) Provisional application No. 60/589,290, filed on Jul. 19, 2004.

(51) Int. Cl.
*G08G 1/00* (2006.01)

(52) U.S. Cl. ..... 340/902; 340/425.5; 340/539.1; 340/825.69; 340/825.72; 340/988; 701/29; 701/33

(58) Field of Classification Search ..... 340/902, 340/903, 905, 995.14, 998, 990, 425.5, 531, 340/539.1, 572.1, 825.69, 995.1, 995, 995.13, 340/988, 825.72; 701/206, 207, 29, 33, 208
See application file for complete search history.

(56) References Cited

U.S. PATENT DOCUMENTS

| | | | |
|---|---|---|---|
| 4,404,639 | A | 9/1983 | McGuire |
| 4,989,146 | A | 1/1991 | Imajo |
| 5,173,691 | A | 12/1992 | Sumner |
| 5,182,555 | A | 1/1993 | Sumner |
| 5,359,529 | A | 10/1994 | Snider |
| 5,388,045 | A | 2/1995 | Kamiya et al. |
| 5,420,794 | A | 5/1995 | James |
| 5,442,553 | A | 8/1995 | Parrillo |

(Continued)

FOREIGN PATENT DOCUMENTS

| | | |
|---|---|---|
| JP | 6276056 | 9/1994 |

(Continued)

OTHER PUBLICATIONS

"The Application of a Novel Two-Way Mobile Satellite Communications and Vehicle Tracking System to the Transportation Industry", Jacobs et al., Feb. 1991, IEEE Transactions on Vehicular Technology, vol. 40, No. 1, pp. 57-63.

*Primary Examiner*—Hung T. Nguyen
(74) *Attorney, Agent, or Firm*—O'Melveny & Myers LLP; Mark E. Duell

(57) ABSTRACT

A method and system facilitate the exchange of information between a remote location and a motor vehicle, via a targeted transmission of audio and visual broadcast messages to vehicle operators. Output of the broadcast messages may be controlled using (a) codes or identifiers in or associated with the messages, (b) one or more user inputs from the vehicle operator, (c) sensor data measuring a vehicle state, or (d) any combination of the foregoing. For example, output of the broadcast messages to vehicle operators may be controlled as to time, frequency, and format (e.g., as visual or audible data) based on any of these control inputs.

24 Claims, 8 Drawing Sheets

U.S. PATENT DOCUMENTS 5,445,347 A 8/1995 Ng
5,506,773 A 4/1996 Takaba et al.
5,508,931 A 4/1996 Snider
5,546,305 A 8/1996 Kondo
5,551,064 A 8/1996 Nobbe et al.
5,563,788 A 10/1996 Yoon
5,590,040 A 12/1996 Abe et al.
5,635,924 A 6/1997 Tran et al.
5,636,245 A 6/1997 Ernst et al.
5,648,768 A 7/1997 Bouve
5,649,300 A 7/1997 Snyder et al.
5,661,787 A 8/1997 Pocock
5,664,948 A 9/1997 Dimitriadis et al.
5,671,195 A 9/1997 Lee
5,682,525 A 10/1997 Bouve et al.
5,696,676 A 12/1997 Takaba
5,699,056 A 12/1997 Yoshida
5,757,645 A 5/1998 Schneider et al.
5,774,827 A 6/1998 Smith et al.
5,802,545 A 9/1998 Coverdill
5,862,510 A 1/1999 Saga et al.
5,864,305 A 1/1999 Rosenquist
5,878,056 A 3/1999 Black et al.
5,892,463 A 4/1999 Hikita et al.
5,926,108 A 7/1999 Wicks et al.
5,931,878 A 8/1999 Chapin, Jr.
5,959,577 A 9/1999 Fan et al.
5,964,811 A 10/1999 Ishii et al.
5,982,298 A 11/1999 Lappenbusch et al.
5,999,882 A 12/1999 Simpson et al.
6,032,046 A 2/2000 Nakano
6,078,865 A 6/2000 Koyanagi
6,085,146 A 7/2000 Kuribayashi et al.
6,111,521 A 8/2000 Mulder et al.
6,169,894 B1 1/2001 McCormick et al.
6,195,602 B1 2/2001 Hazama et al.
6,208,935 B1 3/2001 Yamada et al.
6,212,388 B1 4/2001 Seo
6,236,330 B1 * 5/2001 Cohen ..... 340/691.6
6,240,364 B1 5/2001 Kerner et al.
6,246,320 B1 6/2001 Monroe
6,266,607 B1 7/2001 Meis et al.
6,266,608 B1 7/2001 Pertz
6,292,723 B1 9/2001 Brogan et al.
6,297,748 B1 10/2001 Lappenbusch et al.
6,308,120 B1 10/2001 Good
6,317,686 B1 11/2001 Ran
6,329,925 B1 12/2001 Skiver et al.
6,330,499 B1 12/2001 Chou et al.
6,339,736 B1 1/2002 Moskowitz et al.
6,351,709 B2 2/2002 King et al.
6,356,822 B1 3/2002 Diaz et al.
6,362,730 B2 3/2002 Razavi et al.
6,370,454 B1 4/2002 Moore
6,373,883 B1 4/2002 Sorensen et al.
6,381,533 B1 4/2002 Crane et al.
6,389,337 B1 5/2002 Kolls
6,397,067 B1 5/2002 Tanaka et al.
6,408,307 B1 6/2002 Semple et al.
6,421,593 B1 7/2002 Kempen et al.
6,434,455 B1 8/2002 Snow et al.
6,438,490 B2 8/2002 Ohta
6,459,961 B1 10/2002 Obradovich et al.
6,477,452 B2 11/2002 Good
6,480,105 B2 11/2002 Edwards
6,480,145 B1 11/2002 Hasegawa
6,510,317 B1 1/2003 Marko et al.
6,522,250 B1 2/2003 Ernst et al.
6,526,335 B1 2/2003 Treyz et al.
6,529,143 B2 3/2003 Mikkola et al.
6,539,269 B1 3/2003 Jarrow et al.
6,539,302 B1 3/2003 Bender et al.
6,542,794 B2 4/2003 Obradovich
6,542,822 B1 4/2003 Froeberg
6,549,833 B2 4/2003 Katagishi et al.
6,552,682 B1 4/2003 Fan
6,553,289 B2 4/2003 Maki et al.
6,553,290 B1 4/2003 Pillar
6,553,308 B1 4/2003 Uhlmann et al.
6,553,313 B1 4/2003 Froeberg
6,577,934 B2 6/2003 Matsunaga et al.
6,583,734 B2 6/2003 Bates et al.
6,587,759 B2 7/2003 Obradovich et al.
6,587,777 B1 7/2003 St. Pierre
6,587,787 B1 7/2003 Yokota
6,590,507 B2 7/2003 Burns
6,594,576 B2 7/2003 Fan et al.
6,597,904 B1 * 7/2003 Neustein ..... 455/406
6,603,405 B2 8/2003 Smith
6,604,038 B1 8/2003 Lesesky et al.
6,609,004 B1 8/2003 Morse et al.
6,611,740 B2 8/2003 Lowrey et al.
6,611,753 B1 8/2003 Millington
6,615,130 B2 9/2003 Myr
6,615,133 B2 9/2003 Boies et al.
6,615,186 B1 9/2003 Kolls
6,618,669 B2 9/2003 Ota et al.
6,636,721 B2 10/2003 Threadgill et al.
6,647,417 B1 11/2003 Hunter et al.
6,657,558 B2 12/2003 Horita et al.
6,662,090 B2 12/2003 Toyama et al.
6,662,091 B2 12/2003 Wilson et al.
6,664,922 B1 12/2003 Fan
6,668,219 B2 12/2003 Hwang et al.
6,677,854 B2 1/2004 Dix
6,680,694 B1 1/2004 Knockeart et al.
6,681,120 B1 1/2004 Kim
6,697,633 B1 2/2004 Dogan et al.
6,701,231 B1 3/2004 Borugian
6,701,232 B2 3/2004 Yamaki
6,707,421 B1 3/2004 Drury et al.
6,711,398 B1 3/2004 Talaie et al.
6,714,797 B1 3/2004 Rautila
6,720,920 B2 4/2004 Breed et al.
6,721,685 B2 4/2004 Kodama
6,724,827 B1 4/2004 Patsiokas et al.
6,730,940 B1 5/2004 Steranka et al.
6,732,031 B1 5/2004 Lightner et al.
6,735,416 B1 5/2004 Marko et al.
6,735,504 B2 5/2004 Katagishi et al.
6,738,697 B2 5/2004 Breed
6,741,188 B1 5/2004 Miller et al.
6,741,834 B1 5/2004 Godwin
6,748,317 B2 6/2004 Maruyama et al.
6,754,485 B1 * 6/2004 Obradovich et al. ..... 455/414.1
6,754,570 B2 6/2004 Iihoshi et al.
6,757,712 B1 6/2004 Bastian et al.
6,785,551 B1 8/2004 Richard
6,798,358 B2 9/2004 Joyce et al.
6,804,589 B2 10/2004 Foxford et al.
6,810,323 B1 10/2004 Bullock et al.
6,812,860 B1 11/2004 Schwarzalder, Jr.
6,812,888 B2 11/2004 Drury et al.
6,813,549 B2 11/2004 Good
6,816,778 B2 11/2004 Diaz
6,819,986 B2 11/2004 Hong et al.
6,823,169 B2 11/2004 Marko et al.
6,823,263 B1 11/2004 Kelly et al.
6,836,539 B2 12/2004 Katou et al.
6,836,667 B1 12/2004 Smith, Jr.
6,847,871 B2 1/2005 Malik et al.
6,847,872 B2 1/2005 Bodin et al.
6,847,889 B2 1/2005 Park et al.
6,850,823 B2 2/2005 Eun et al.

| | | | | |
|---|---|---|---|---|
| 6,859,720 | B2 | 2/2005 | Satoh et al. | |
| 6,870,487 | B2 | 3/2005 | Nuesser et al. | |
| 6,901,374 | B1 | 5/2005 | Himes | |
| 6,911,918 | B2 | 6/2005 | Chen | |
| 6,920,382 | B2 | 7/2005 | Katagishi et al. | |
| 6,928,423 | B1 | 8/2005 | Yamanaka | |
| 6,944,430 | B2 | 9/2005 | Berstis | |
| 6,971,070 | B2 | 11/2005 | Obradovich et al. | |
| 6,983,200 | B2 * | 1/2006 | Bodin et al. | 701/33 |
| 6,987,964 | B2 | 1/2006 | Obradovich et al. | |
| 7,174,301 | B2 * | 2/2007 | Florance et al. | 705/1 |
| 7,184,866 | B2 * | 2/2007 | Squires et al. | 701/33 |
| 7,216,109 | B1 * | 5/2007 | Donner | 705/64 |
| 2001/0001848 | A1 | 5/2001 | Oshizawa et al. | |
| 2002/0002534 | A1 | 1/2002 | Davis et al. | |
| 2002/0016655 | A1 | 2/2002 | Jao | |
| 2002/0029339 | A1 | 3/2002 | Rowe | |
| 2002/0032507 | A1 | 3/2002 | Diaz et al. | |
| 2002/0044049 | A1 | 4/2002 | Saito et al. | |
| 2002/0049531 | A1 | 4/2002 | Tanaka et al. | |
| 2002/0067289 | A1 | 6/2002 | Smith | |
| 2002/0072378 | A1 | 6/2002 | Gaal | |
| 2002/0077741 | A1 | 6/2002 | Hanebrink | |
| 2002/0080022 | A1 | 6/2002 | Edwards | |
| 2002/0087237 | A1 | 7/2002 | Ol et al. | |
| 2002/0103582 | A1 | 8/2002 | Ohmura et al. | |
| 2002/0103583 | A1 | 8/2002 | Ohmura et al. | |
| 2002/0103597 | A1 | 8/2002 | Takayama et al. | |
| 2002/0152021 | A1 | 10/2002 | Ota et al. | |
| 2002/0156692 | A1 | 10/2002 | Squeglia | |
| 2002/0161495 | A1 | 10/2002 | Yamaki | |
| 2002/0161841 | A1 | 10/2002 | Kinnunen | |
| 2002/0165662 | A1 | 11/2002 | Maruyama et al. | |
| 2002/0165665 | A1 | 11/2002 | Kim | |
| 2002/0176494 | A1 | 11/2002 | Zhao et al. | |
| 2002/0177926 | A1 | 11/2002 | Lockwood et al. | |
| 2002/0193923 | A1 | 12/2002 | Toyama et al. | |
| 2002/0198632 | A1 | 12/2002 | Breed et al. | |
| 2002/0198637 | A1 | 12/2002 | Shibata | |
| 2003/0028297 | A1 | 2/2003 | Iihoshi et al. | |
| 2003/0051239 | A1 | 3/2003 | Hudspeth | |
| 2003/0063628 | A1 | 4/2003 | Marko et al. | |
| 2003/0069683 | A1 | 4/2003 | Lapidot | |
| 2003/0081587 | A1 | 5/2003 | Ichiyoshi | |
| 2003/0083813 | A1 | 5/2003 | Park | |
| 2003/0093476 | A1 | 5/2003 | Syed | |
| 2003/0095038 | A1 | 5/2003 | Dix | |
| 2003/0109972 | A1 | 6/2003 | Tak | |
| 2003/0158640 | A1 | 8/2003 | Pillar et al. | |
| 2003/0169182 | A1 | 9/2003 | Wilhelm et al. | |
| 2003/0191583 | A1 | 10/2003 | Uhlmann et al. | |
| 2003/0195695 | A1 | 10/2003 | Maruyama et al. | |
| 2003/0195814 | A1 | 10/2003 | Striemer | |
| 2003/0216859 | A1 | 11/2003 | Martell et al. | |
| 2003/0225516 | A1 | 12/2003 | DeKock et al. | |
| 2003/0229441 | A1 | 12/2003 | Pechatnikov et al. | |
| 2003/0236613 | A1 | 12/2003 | Satoh et al. | |
| 2004/0012501 | A1 | 1/2004 | Mazzara et al. | |
| 2004/0024753 | A1 | 2/2004 | Chane et al. | |
| 2004/0044605 | A1 | 3/2004 | Kress Bodin et al. | |
| 2004/0059781 | A1 | 3/2004 | Yoakum et al. | |
| 2004/0068362 | A1 | 4/2004 | Maekawa et al. | |
| 2004/0068364 | A1 | 4/2004 | Zhao et al. | |
| 2004/0073356 | A1 | 4/2004 | Craine | |
| 2004/0080430 | A1 | 4/2004 | Videtich | |
| 2004/0085198 | A1 | 5/2004 | Saito et al. | |
| 2004/0093243 | A1 | 5/2004 | Bodin | |
| 2004/0102898 | A1 | 5/2004 | Yokota et al. | |
| 2004/0104842 | A1 | 6/2004 | Drury et al. | |
| 2004/0110515 | A1 | 6/2004 | Blumberg et al. | |
| 2004/0148099 | A1 | 7/2004 | Kim | |
| 2004/0167707 | A1 | 8/2004 | Bragansa et al. | |
| 2004/0198217 | A1 | 10/2004 | Lee et al. | |
| 2004/0203630 | A1 | 10/2004 | Wang | |
| 2004/0204821 | A1 | 10/2004 | Tu | |
| 2004/0204842 | A1 | 10/2004 | Shinozaki | |
| 2004/0208204 | A1 | 10/2004 | Crinon | |
| 2004/0233070 | A1 | 11/2004 | Finnern | |
| 2004/0233101 | A1 | 11/2004 | Kim | |
| 2004/0239531 | A1 | 12/2004 | Adamczyk | |
| 2004/0249529 | A1 | 12/2004 | Kelly et al. | |
| 2004/0249530 | A1 | 12/2004 | Kelly et al. | |
| 2004/0249531 | A1 | 12/2004 | Kelly et al. | |
| 2004/0249532 | A1 | 12/2004 | Kelly et al. | |
| 2004/0252197 | A1 | 12/2004 | Fraley et al. | |
| 2004/0260786 | A1 | 12/2004 | Barile | |
| 2005/0001743 | A1 | 1/2005 | Haemerle | |
| 2005/0015186 | A1 | 1/2005 | Kelly et al. | |
| 2005/0015199 | A1 | 1/2005 | Lokshin et al. | |
| 2005/0021197 | A1 | 1/2005 | Zimmerman et al. | |
| 2005/0021199 | A1 | 1/2005 | Zimmerman et al. | |
| 2005/0027436 | A1 | 2/2005 | Yoshikawa et al. | |
| 2005/0027449 | A1 | 2/2005 | Marsh | |
| 2005/0033511 | A1 | 2/2005 | Pechatnikov et al. | |
| 2005/0038581 | A1 | 2/2005 | Kapolka et al. | |
| 2005/0038596 | A1 | 2/2005 | Yang et al. | |
| 2005/0043880 | A1 | 2/2005 | Yamane et al. | |
| 2005/0060070 | A1 | 3/2005 | Kapolka et al. | |
| 2005/0068174 | A1 | 3/2005 | Oesterling et al. | |
| 2005/0075095 | A1 | 4/2005 | Dillon | |
| 2005/0080519 | A1 | 4/2005 | Oesterling et al. | |
| 2005/0090951 | A1 | 4/2005 | Good | |
| 2005/0096811 | A1 | 5/2005 | Bodin et al. | |
| 2005/0125117 | A1 | 6/2005 | Breed | |
| 2005/0131626 | A1 | 6/2005 | Ignatin | |
| 2005/0137763 | A1 | 6/2005 | Watkins | |
| 2005/0137790 | A1 | 6/2005 | Yamada et al. | |
| 2005/0273218 | A1 | 12/2005 | Breed et al. | |
| 2005/0288856 | A1 | 12/2005 | Uyeki et al. | |
| 2006/0055565 | A1 | 3/2006 | Kawamata et al. | |

FOREIGN PATENT DOCUMENTS

| | | |
|---|---|---|
| JP | 8149029 | 6/1996 |
| JP | 2000201104 | 7/2000 |
| JP | 2000293788 | 10/2000 |
| JP | 2001168743 | 6/2001 |

* cited by examiner

METHOD AND SYSTEM FOR BROADCASTING AUDIO AND VISUAL DISPLAY MESSAGES TO A VEHICLE

CROSS-REFERENCE TO RELATED APPLICATION

This application claims priority pursuant to 35 U.S.C. § 119(e) to U.S. Provisional Application No. 60/589,290, filed Jul. 19, 2004, which application is specifically incorporated herein, in its entirety, by reference.

BACKGROUND OF THE INVENTION

1. Field of the Invention

The present invention relates to a method and system for communicating information to vehicles from a remote location, and more particularly, to a method and system for communicating audio and visual display messages to a vehicle.

2. Description of Related Art

There are many instances in which it is desirable to communicate messages to the operator of a vehicle. For example, vehicle manufactures may wish to communicate messages to the vehicle operator to provide reminders to perform periodic maintenance. The upkeep and maintenance of vehicles is essential to maintain a vehicle in good running condition and to maintain the overall reputation of a vehicle manufacturer. If a vehicle malfunctions or breaks down because of user neglect, as opposed to a vehicle defect, not only is the vehicle operator inconvenienced, the reputation of the vehicle manufacturer will be harmed. Thus, as users often neglect to regularly service their vehicles, upgrade their vehicles with improved replacement parts, and in some cases, even forget to replace recalled vehicle parts—it is important to remind users to service their vehicles. In addition to such reminders, vehicle manufacturers may also wish to communicate with vehicle operators regarding lease and loan status, special discounts for vehicle service and replacement parts, and vehicle recall notices.

It is known in the art to communicate broadcast messages using radio signals to many members of the general public. Such messages are not specific to certain vehicle owners, and instead may be received by all vehicle operators within a particular geographic area. These broadcast messages may include both audio and visual display information. For example, a radio station may broadcast a news or entertainment audio program along with an embedded data track that contains an identification of the radio station, the name of the artist or song, and other textual information. This information would be displayed on a visual display within the vehicle. Notably, both the audio and video information is presented continuously to the vehicle operator, i.e., the audio and video information cannot be captured for later presentation. Moreover, the vehicle operator cannot select between the audio and visual formats for presentation.

These known information broadcasting systems are unsuitable for communicating specific messages to the vehicle operator for a number of reasons. First, as noted above, the broadcast messages are communicated to all members of the public, and cannot be targeted for receipt only by specific members of the public, e.g., owners of certain makes/models of vehicles. Second, the extent of content of the visual information is necessarily limited, and would not be appropriate for communicating a lengthy or detailed message. More specifically, it would be impractical for a vehicle operator to receive a lengthy visual message while driving the vehicle, and so visual information is limited to very short, repetitive communications, e.g., a radio station identification. Third, the vehicle operator cannot capture the audio and visual broadcasts for later presentation, such as at a later time when the vehicle is not in motion and it is convenient to review the broadcast message. The audio and visual broadcasts are presented in real time, and if the vehicle operator misses them, communication has failed. Fourth, the vehicle owner does not have any flexibility in choosing between audio and visual formats of the message. The messages are reproduced as they are received, and the vehicle operator cannot select between audio and visual message formats.

As a result, there remains a need for methods that allow for the targeted transmission of audio and visual broadcast messages to vehicle operators and the selective playback of the broadcast messages by vehicle operators at a time and format most convenient to the vehicle operators.

DETAILED DESCRIPTION OF THE PREFERRED EMBODIMENT

The present invention is directed to a system and method for facilitating the exchange of information between a remote location and a vehicle. In particular, the present invention is directed to a system and method for the targeted transmission of audio and visual broadcast messages to vehicle operators and the selective playback of the broadcast messages by vehicle operators at a time and format most convenient to the vehicle operators. In the detailed description that follows, like element numerals are used to indicate like elements presented in one or more of the figures.

More particularly, a broadcast data output system is provided for outputting vehicle broadcast data including text data. The broadcast data output system includes a receiver provided in the vehicle for receiving the broadcast data, a storage device for storing the received broadcast data, a text display device for displaying at least a portion of the text data included in the broadcast data stored in the storage device, and a voice message output device for converting at least a portion of the text data included in the broadcast data stored in the storage device into voice message and outputting the voice message. The text display device may further display a portion of the text data to be converted into voice message, or may display an entirety of the text data to be converted into voice message.

In an embodiment of the invention, the system further includes a voice message output manual start device for starting the voice message output device by a manual operation for outputting the voice message during a display of the text data by the text display device.

In another embodiment of the invention, the system further includes a voice message output automatic start device for automatically starting the voice message output device for outputting the voice message during a display of the text data by the text display device.

In another embodiment of the invention, the system includes a voice message output manual start device for starting the voice message output device by a manual operation for outputting the voice message during a display of the text data by the text display device, and a voice message output automatic start device for automatically starting the voice message output device for outputting the voice message during a display of the text data by the text display device. The broadcast data may include a flag or command for selectively activating one of the voice message output manual start device and the voice message output automatic start device. The system may further include a switching device for selectively activating one of the voice message output manual start device and the voice message output automatic start device according to the flag or command state.

Figure 1:
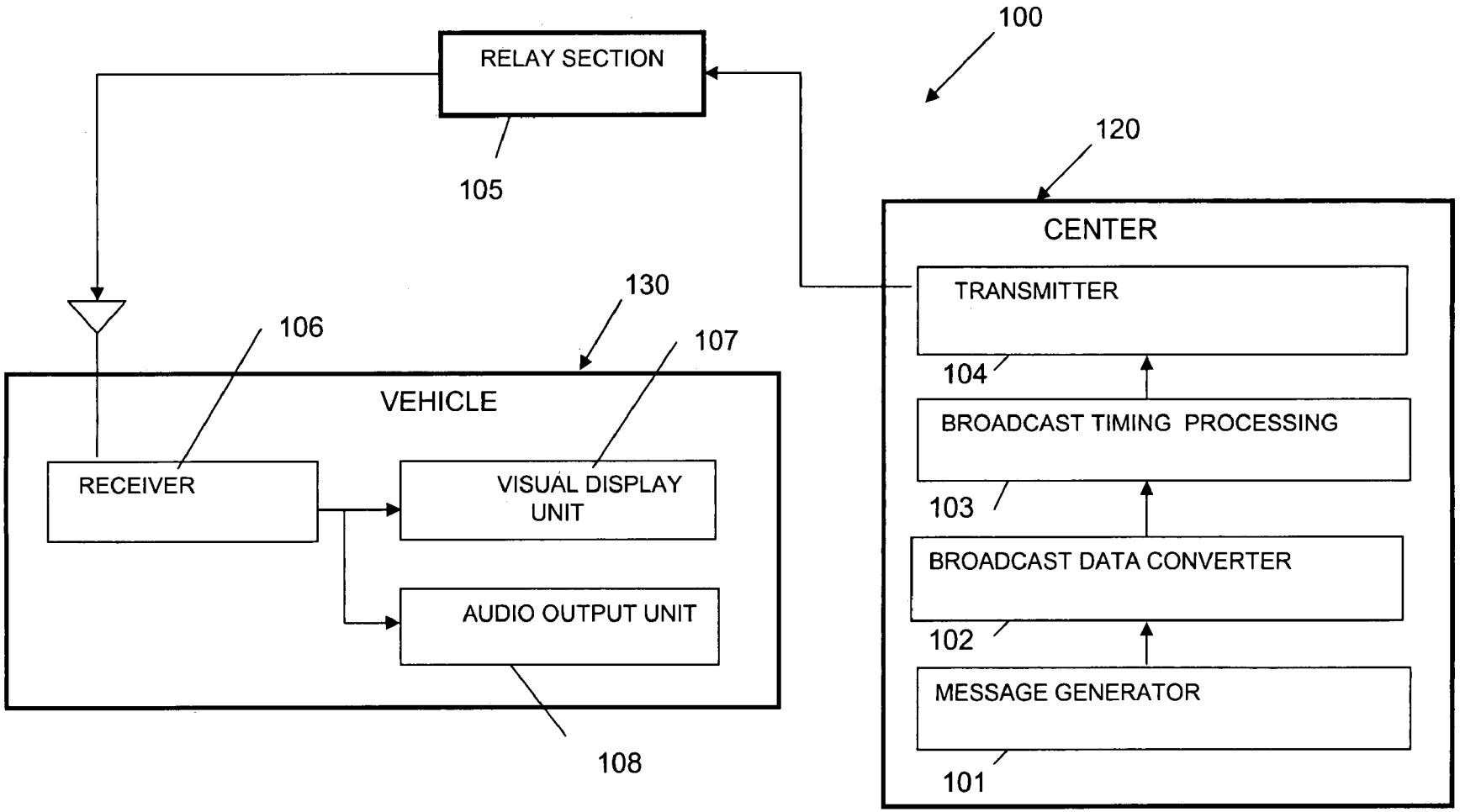
FIG. 1 is a schematic diagram of a system for communicating broadcast messages to a vehicle pursuant to aspects of the invention.

Referring now to FIG. 1, a schematic diagram of the present information provision system for a vehicle is shown according to an embodiment of the present invention. Broadcast messages may originate from any suitable a remote location, referred to herein as a center 120. The center may communicate the broadcast message via a relay section 105 to each vehicle. The medium for communicating the broadcast messages may include a one-to-many communication system that can send information from one source to a plurality of receivers. Examples of suitable one-to-many communications systems include television, radio and satellite networks. In one embodiment, the relay section 105 comprises the XM Radio satellite network, which includes a network of broadcast towers, satellite servers and satellites. In the alternative, the broadcast messages may be transmitted to the vehicle over a high bandwidth GPRS/1XRTT channel of a wireless communication network. If the high bandwidth channel is unavailable, a low bandwidth DTMF channel may be used.

The message origination center 120 may comprise a message generator 101 for generating message data directed towards vehicle operators. It should be appreciated that messages may be generated by a variety of different methods. For example, a human operator may compose a message, such as a recall or safety notices, for distribution to a defined group of motor vehicles. For further example, a computer and vehicle database may be used to operate an automatic message-generation algorithm, for generating maintenance reminders, advertising, or other messages targeted to a specific vehicle or group of motor vehicles.

Center 120 may further comprise a broadcast data converter 102 for converting the generated message into a broadcast data format. For example, a message from generator 101 may be encoded in a certain format, e.g., ASCII Text, that is not optimal or suitable for wireless broadcasting. A converter 102 may therefore first convert the data into a format suitable for broadcast using a selected wireless broadcast system. In the alternative, generator 101 may provide the message in broadcast-suitable format, and converter 102 may be omitted.

Center 120 may also comprise a broadcast timing processing section 103 that determines the timing for sending message data converted into broadcast data by the broadcast data converter 102. For example, a message may be generated during the night and saved for broadcasting during the morning. Section 103 may be operably associated with a message storage system for queuing messages or otherwise holding them until ready for broadcast.

When a message is ready for transmitting to a specific motor vehicle or group of motor vehicles, a transmitter 104 may be used for transmitting broadcast data sent from the broadcast timing processing section 103 or other component of center 120. Any suitable transmitter as known in the art may be used.

In an embodiment of the invention, a relay section 105 may receive the broadcast data and relay it to the vehicle. Any suitable broadcast relay station as known in the art may be used to ensure sufficient broadcast signal strength over the area a motor vehicle is located in. Vehicle location may be tracked using a suitable sensor in the motor vehicle, for example a GPS locator, so the broadcast can be targeted to a specific area. In the alternative, the message may be broadcast over a wide geographic area, such as a metropolitan area, state, or country of residence of the vehicle operator.

It should be appreciated that the message generator 101, broadcast data converter 102, and/or broadcast timing processing section 103 may be provided by computer servers having associated memory. These servers may further include capacity to maintain data records corresponding to the vehicles and vehicle operators to which the center 120 communicates. The broadcast data may comprise, for example, information related to the vehicle user such as sales campaign periods for dealers and the like, specific regional information, seasonal information, inspection periods, recall information, and lease periods, and information dispatched in accordance with need from the center, and the like. The center may also be in communication with information providers such as vehicle dealers, repair/maintenance facilities, and other service providers by way of conventional communications networks. A plurality of user profiles may be included in a user profile database, which, along with other vehicle-related information, may be stored in a suitable memory operably associated with center 120.

A motor vehicle 130 for receiving broadcast messages includes a receiver 106 that is capable of receiving broadcast data relayed from the relay section 105 via a suitable antenna. The receiver 106 includes processing capability to recover the broadcast data and communicate that information to a visual display system 107 and to an audible output system 108, such as an amplifier/loudspeaker. The display system 107 may comprise the visual display of a navigation device, or the like. The audio output system 108 may comprise the speaker of an audio device, coupled to a suitable amplifier.

Figure 2:
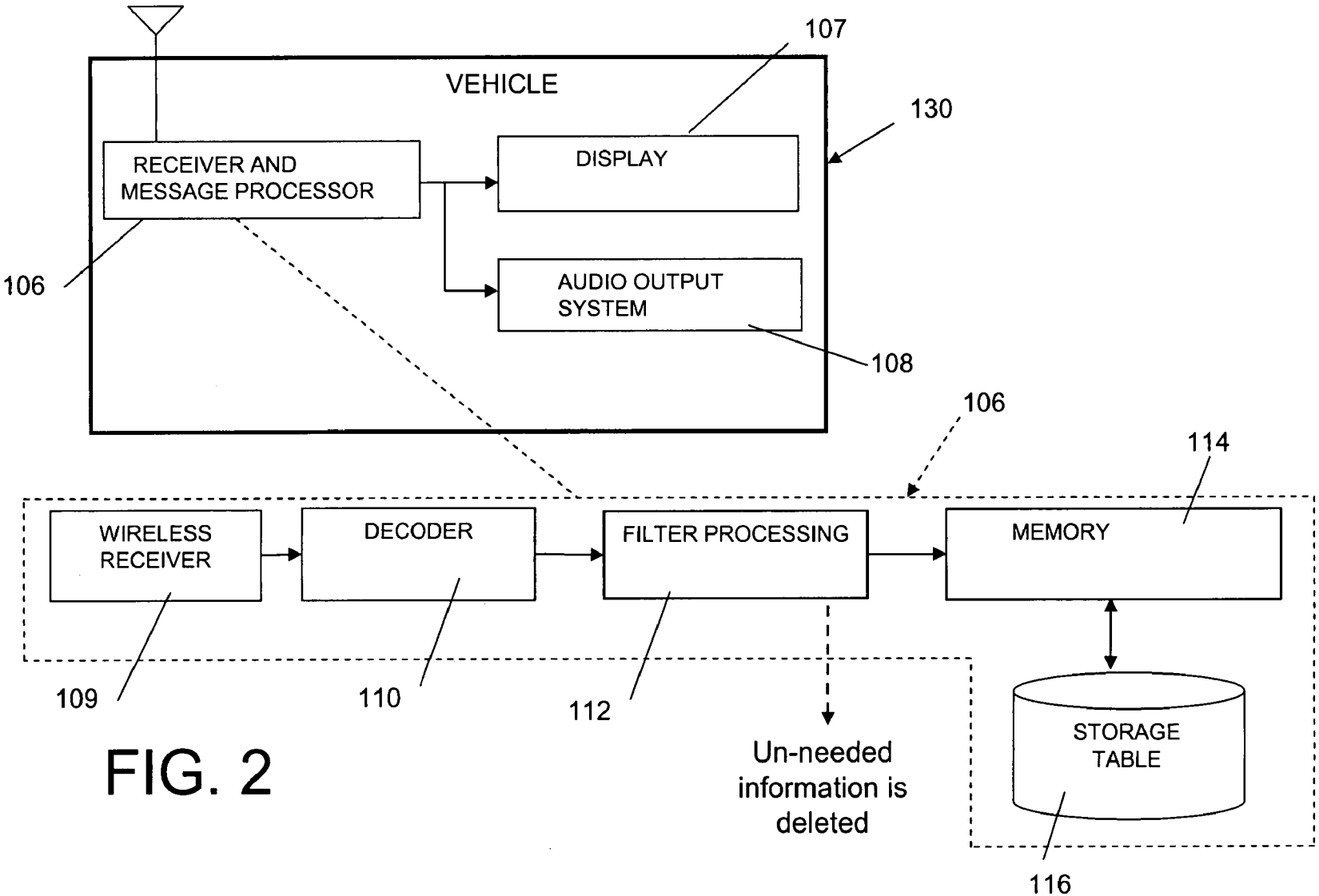
FIG. 2 is a schematic diagram of an exemplary vehicle information receiver of the system.

FIG. 2 illustrates suitable components of the receiver 106 in greater detail. In an embodiment of the invention, receiver 106 may comprise a conventional reception unit 109 for receiving a wireless signal. Downstream of the reception unit, the receiver may further comprise a decoder 110, a filter processing section 112, and a memory 114. Broadcast data received by the receiver 106 may decoded by decoder 110 to separate the data according to the broadcast band into broadcast data from the center 120 and general broadcast data from the relay section 105. The memory 114 may store all or a portion of received broadcast data after processing by the filter processing section 112. This memory 114 may comprise is any suitable storage medium, including but not limited to magnetic media such as a hard disc or a non-volatile electronic memory chip.

The broadcast data may include a unique identifier (ID) by which the center 120 may identify a targeted motor vehicle or group of motor vehicles intended to receive the broadcast data. Only a receiver 106 that possesses, in advance, an ID that matches the ID of the broadcast data can receive the broadcast data. For example, the ID may comprise a serial number or the like that has already been determined in advance. In addition, the information data that is sent from the center may also include data that is linked by conditions based on particular groupings. These groupings include, for example, manufacturing year model, product name, vehicle manufacturer, customer name, dealer name, purchase date, registration date, lease period, and the like.

The filter processing section 112 determines whether or not the broadcast data received from the center satisfies the above-mentioned conditions. If the conditions do not match, the received broadcast data may be automatically deleted as not pertaining to the vehicle 130 in which receiver 106 is located. By filtering the broadcast data in this manner, messages may be targeted to a particular vehicle or group of vehicles, user privacy may be safeguarded, and utilization of memory 114 may be effectively managed. When the broadcast flag or ID associated with the message from center 120 matches the ID or vehicle conditions stored in memory 114, the broadcast message data may be stored in a storage table 116.

Other conditions may include or be derived from vehicle sensor data. For example, data from an odometer, speedometer, fluid level gauge, fluid pressure gauge, clock, temperature gauge, GPS receiver, or other sensor may be collected at used to determine whether or not received data should be stored, or when data should be presented to the vehicle operator. For example, maintenance reminders may be filtered in response to odometer readings, or certain messages may be held for presentation when the vehicle is not moving as indicated by the speedometer.

Figure 3:
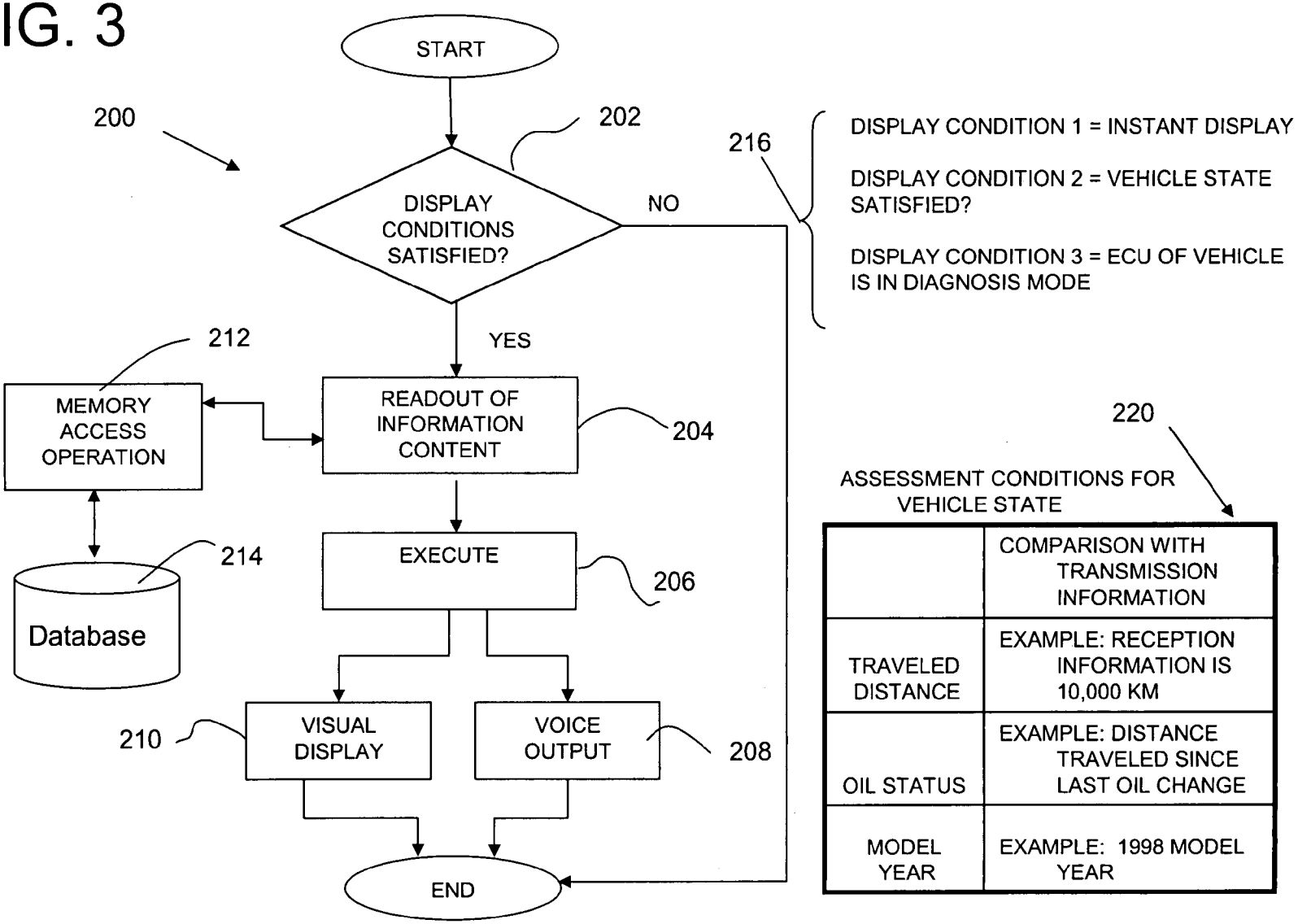
FIG. 3 is a flow diagram of a method for presenting broadcast messages to a vehicle operator.

FIG. 3 illustrates a method 200 for presenting received broadcast data to the vehicle operator. First, in step 202, a determination is carried out as to whether the vehicle is in agreement with the conditions stored in advance. In the exemplary embodiment, three predetermined display conditions 216 are tested in step 202. It should be appreciated that any number of desired conditions of various types may be tested. In the illustrated embodiment, a first condition of conditions 216 relates to whether the broadcast data should be presented immediately after being received. A second condition relates to whether a condition matches a vehicle physical state. And, a third condition relates to whether an electronic control unit (ECU) of the vehicle is in diagnosis mode or not.

The vehicle physical state refers to the state of physical characteristics inherent to the vehicle such as the traveled distance, the oil status, and the model year. For example, using individually predetermined thresholds, such as for traveled mileage, periods for replacement of replacement parts, and the like, it can be determined whether the state of the vehicle at the present time exceeds the thresholds. If the conditions specified for an incoming message are not satisfied, the processing may be stopped at 218 without outputting or storing the received message. Table 220 of FIG. 3 shows an exemplary vehicle state table with three conditions. A code specifying a single condition, or any combination of multiple conditions, may be associated by center 120 with a particular message.

Likewise, a code or information associated with a message may indicate a particular time for display, or that a message should be displayed when the ECU is in a diagnosis mode. In such case, a message may be discarded if the timing condition is not satisfied, and method 200 may end at 218. In the alternative, the message may be saved at step 212.

If the conditions 216 are satisfied in step 202, the associated message information may be processed at step 206 for visual and audio output at steps 208, 210. In the alternative, or in addition, all or a portion of message information may be obtained from a memory access operation 212 and compiled into a desired message at step 204. For example, a message may be associated with a code or memory address indicating a memory location where information stored in a database 214 may be found. Stored visual or audio message data may be retrieved from database 214, and combined with received message data at step 204.

At step 206, a message compiled at step 206 may be formatted for output to an intended audio or visual output device. For example, a portion of the message may comprise text data fro visual output. This visual message portion may be processed for output to a suitable display system or device. Likewise, all or a portion of the message may comprise data marked for audio output. This audio output may be processed for output to an audio output device, such as by processing using a text-to-speech synthesizer. As explained in more detail later in the specification, a particular message may comprise a string of text data with defined portions for visual and audio output. Advantageously, such a message may be readily encoded and transmitted over a wireless connection while minimizing bandwidth requirements. In the alternative, alternative forms of message data may be used, such as graphical data.

Message data for display may be displayed at step 210, such as by using an existing vehicle display system. Many vehicles are equipped with video display screens for navigation and other functions. It is anticipated that all or a portion of such as display may be used to present a text message. Likewise, many vehicles are equipped with a sound system for playing music, that may be used at step 208 for audio output. For example, text data may be synthesized into speech by an on-board computer, and played on the vehicle's sound system, or using a separate loudspeaker. It is desirable to present both audio and visual data to the vehicle user.

Exemplary variations and details of message output are provided in the following discussion of FIGS. 4-8. It should be appreciated that the messages and control codes presented are merely exemplary, and the invention may be used to present any desired message to a vehicle operator, using any desired form of control code. Also, while each of the examples below illustrates the operation of a single code type, it should be appreciated that multiple different code types may be combined in an interoperable fashion in a single message.

Figure 4:
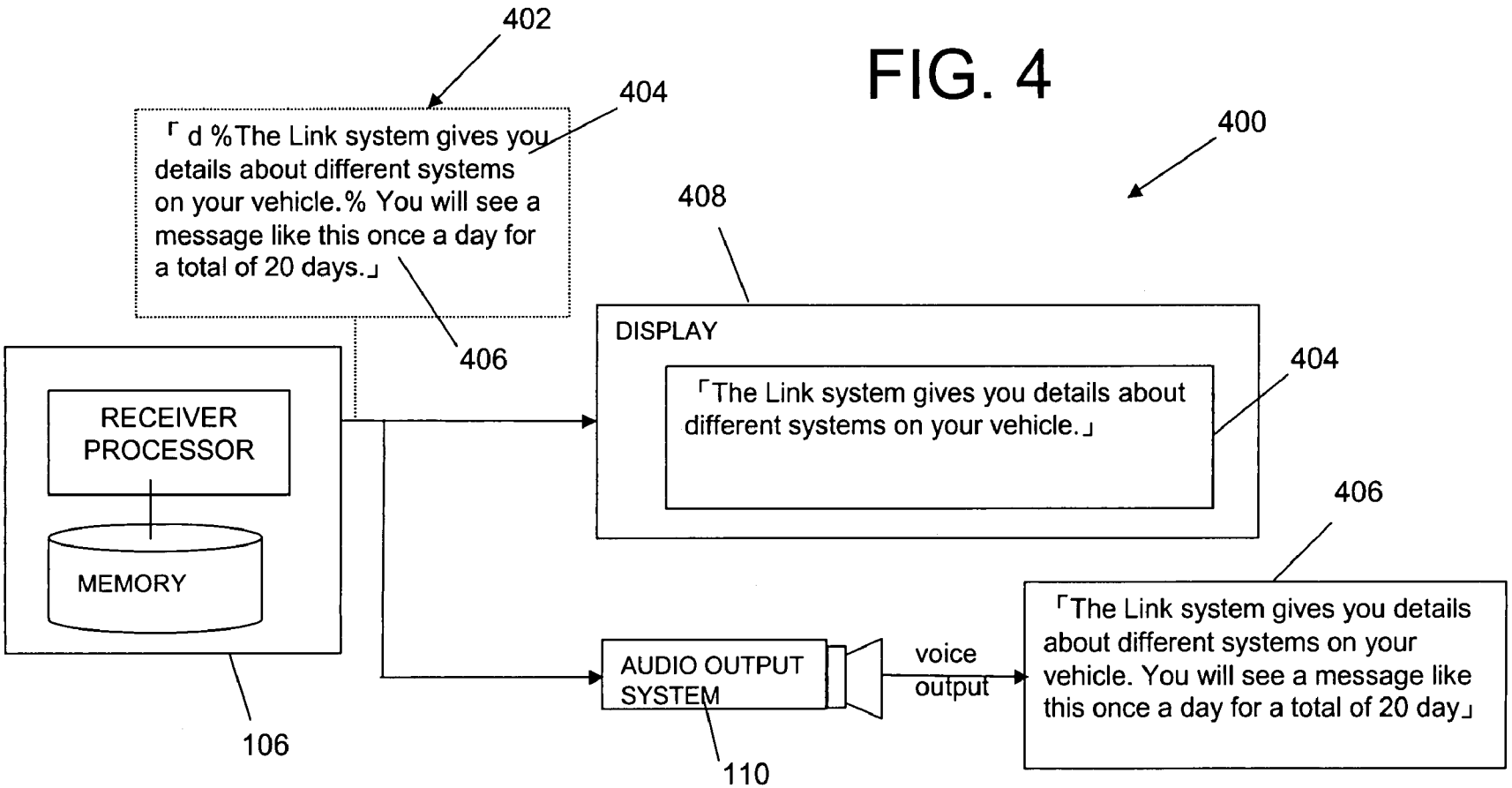
FIGS. 4-8 are schematic diagrams illustrating exemplary methods of presenting broadcast messages to the vehicle operator in accordance with the present invention.

Referring now to FIG. 4, a system 400 for presenting broadcast message data 402 to a vehicle operator in both visual and audio forms is shown. Message data may be received by receiver 130 and stored in a memory 214. It should be appreciated that the data in memory 214 may have been wirelessly received at an earlier time, placed into memory during vehicle maintenance or manufacturing, or some combination of the foregoing. In the alternative, or in addition, message data may be used as received from a wireless broadcast, without first storing in a non-volatile memory. Message data 402 comprises control codes, here indicated as "d %" and "%," that define an amount of text that is presented visually to the vehicle operator, i.e., a visual portion 404 of message 402. Message 402 further comprises an audio portion 402. In the illustrated embodiment, audio portion 406 comprises the same text as the visual portion 404, plus additional text after the visual portion. The message 402 may be parsed using a suitable processor, and the visual portion output to a display device 408. For example, if the message 402 may comprise:

d % The Link system gives you details about different systems on your vehicle. % You will see a message like this once a day for a total of 20 days.

In this example, the code "d %" indicated a beginning of a visual message portion 404. The data between the first "%" and the second "%" will be presented visually as text on display 408. Specifically, the display. 408 will show the message: "The Link system gives you details about different systems on your vehicle." In addition, the "d %" code here indicates that the entire message should be considered an audio portion 406 to be presented to the vehicle operator by the voice output device 410. Advantageously, by displaying less than the entire message on display 404, the vehicle operator is not required to read a lengthy message. Meanwhile, the entire message may be communicated by voice output. By limiting the visual display of essential information while providing audio output of more detailed information, communication with the vehicle operator may be achieved in a more optimal manner.

Figure 5:
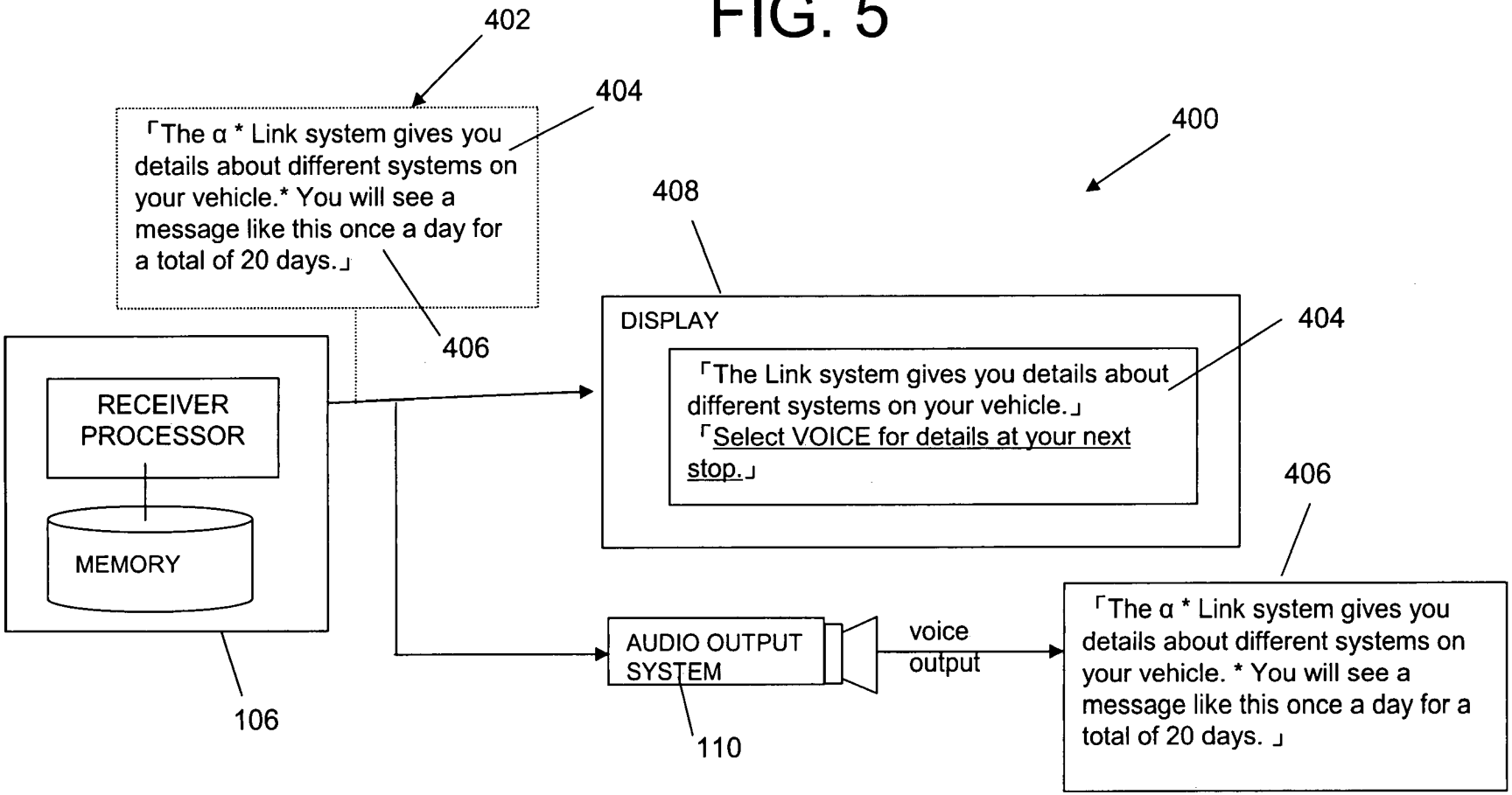

FIG. 5 shows a different operation of system 400, in which a control code "α *" is included in the broadcast message data 402 to cause a predetermined stored text phrase to be included with the visual output. The predetermined text phrase may be retrieved from memory 214 and combined with message 402 received via a wireless transmission. The voice output may or may not include the predetermined text phrase, as desired. As a specific example, message 204 may comprise:

The α * Link system gives you details about different systems on you vehicle. * You will see a message like this once a day for a total of 20 days."

In this example, message portion "Link system gives you details about different systems on your vehicle," will be displayed as a visual message portion on display 408. In, addition, stored data from memory 214 corresponding to "α" is added to the visual display data. For example, if the stored "α" data is "Select VOICE for details at your next stop", the visual display data 404 will be displayed as follows: "Link system gives you details about different systems on your vehicle. Select VOICE for details at your next stop." Then, audio message portion 406, which include additional information, may be played if the vehicle operator selects a designated VOICE button on a vehicle equipment panel or touchscreen.

Figure 6:
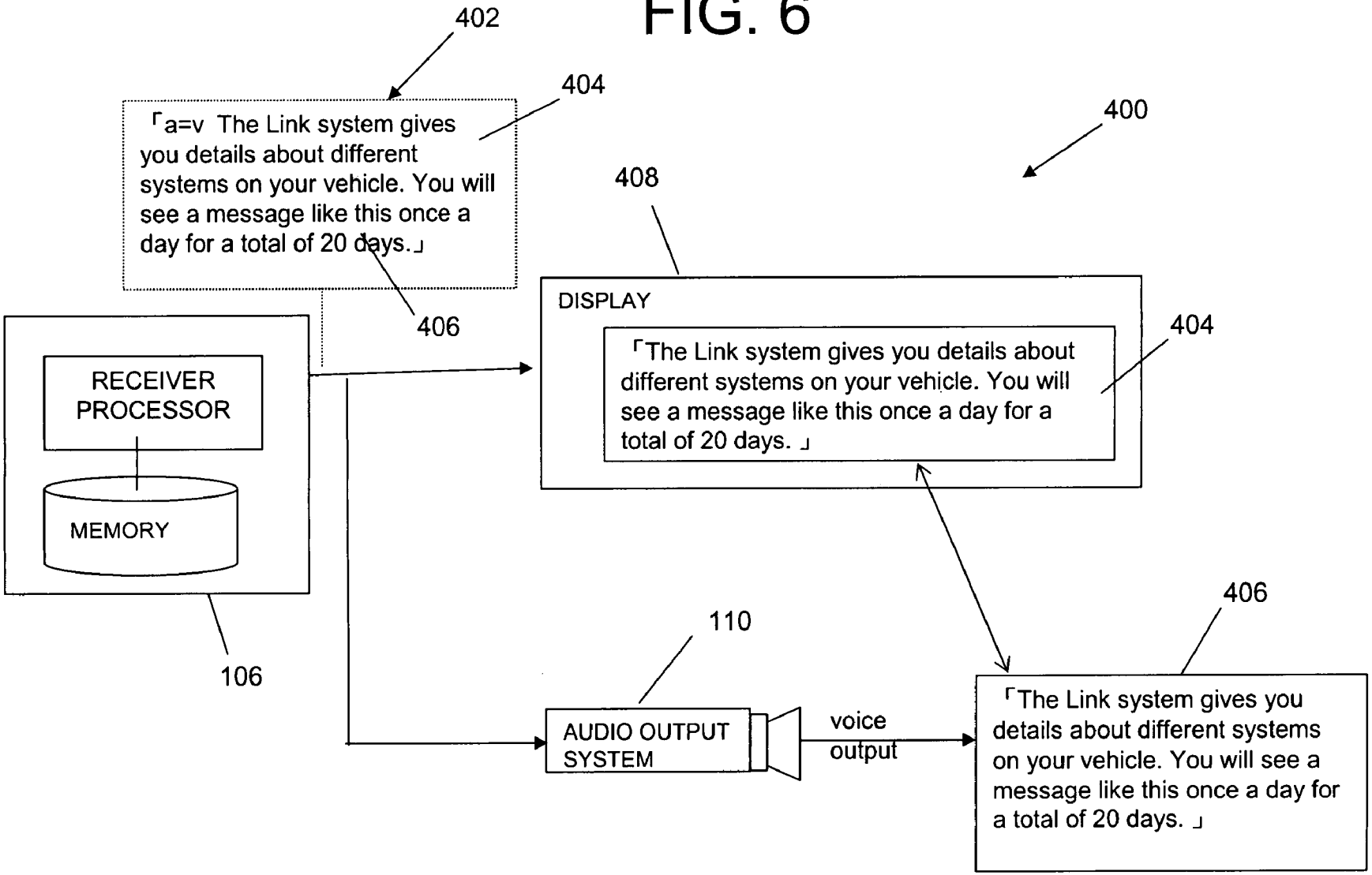

FIG. 6 illustrates use of a control code in message data 402 for equating the visual and audio portions 404, 406. Specifically, message 402 may comprise:

a=v The link system gives you details about different systems on your vehicle. You will see a message like this once a day for a total of 20 days."

In this example, the command code "a=v" causes both the display 408 and the audio system 410 to notify the user of the same information, i.e., "The Link system gives you details about different systems on your vehicle. You will see a message like this once a day for a total of 20 days". In other words, the visual message portion 404 and the audio message portion 408 contain the same information.

Figure 7:
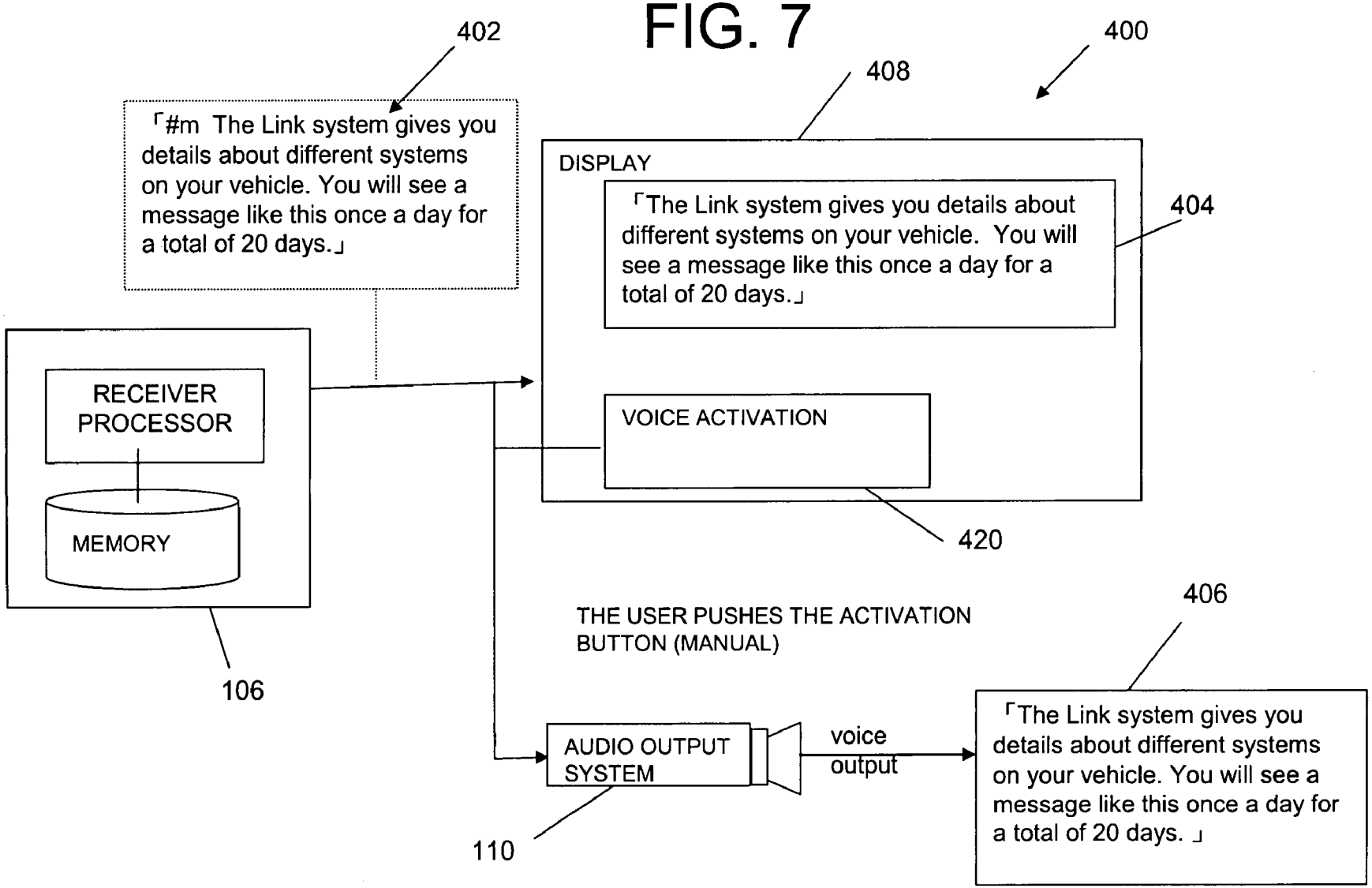

FIG. 7 illustrates handling of a message 402 comprising a control code for causing a voice output activation feature 420 to be displayed, such as on a touchscreen portion of display. The audio output portion 406 is produced only when the vehicle operator selects the voice activation feature 420. For example, message 402 may comprise:

#m The Link system gives you details about different systems on your vehicle. You will see a message like this once a day for a total of 20 days.

In this example, a command code "#m" may be interpreted by a message processor in the vehicle as a command to activate or display a voice activation button 420 to be presented on the display 408. If the vehicle operator presses the voice activation button, audio message portion 406 is output from the audio output system 410. The voice activation feature may comprise, for example, a touch-operated region of a touchscreen display, a voice operated command, or a mechanical switch or dial corresponding to a region of the display. This embodiment enables the vehicle operator to have the voice output produced only if manually selected.

Figure 8:
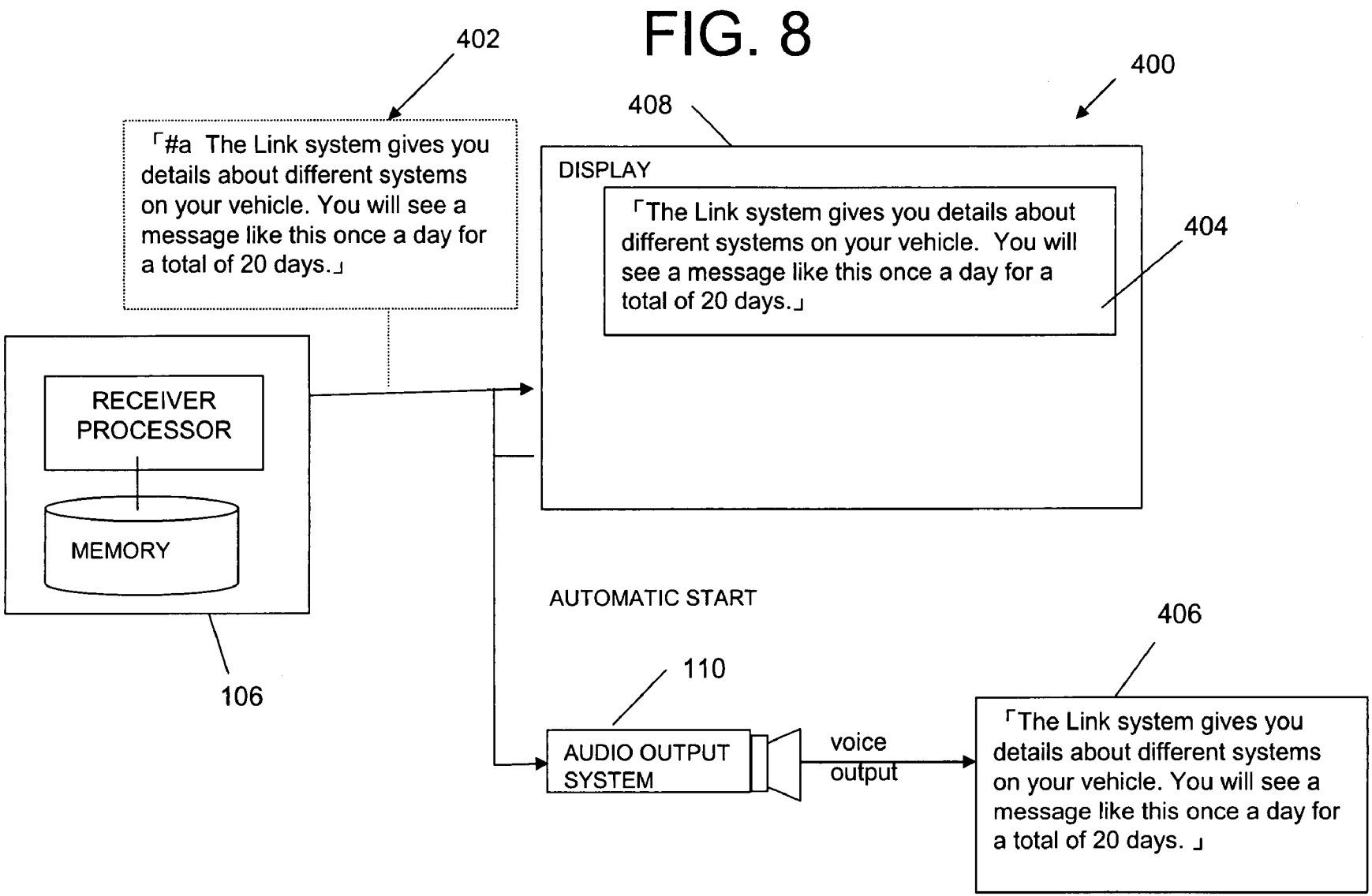

Conversely, a message may be provided with a control code to override or disable operation of a voice activation feature, as shown in FIG. 8. Automatic voice output may be desirable, for example, for use with high-priority messages such as responses to emergency calls. A message 402 may comprise a control code that causes the voice output to be automatically reproduced (instead of selectively produced as in the previous embodiment). Message 402 may also be displayed on the display 408. For example, message 402 may comprise:

#a The Link system gives you details about different systems on your vehicle. You will see a message like this once a day for a total of 20 days.

In this example, the control code "#a" causes the audio output system 410 to be activated automatically, and the message data will be output as voice output. In order for either of manual activation or automatic activation of the voice output, a flag or command may be contained in the broadcast data received from the center. The status of the flag or command may be determined when data display is activated, and accordingly, automatic or manual voice output activation will be carried out.

The foregoing examples demonstrate exemplary ways in which the output mode of a message broadcast to a motor vehicle may be controlled. In particular, a message may be divided into a visual portion and an audio portion, which may comprise overlapping message data. Either visual or audio data may also be stored at a motor vehicle, and activated by broadcasting an appropriate command to a targeted vehicle. In an embodiment of the invention, message data comprises text data that may be output in either or both visual and audio modes. This form of data is compact for ease of transmission, and may readily be processed for visual and audio output using text display and text-to-speech methods as known in the art.

Using both audio and visual output for the same or overlapping message data may be advantageous for vehicle operators, by providing critical information in a redundant fashion. Also, interruptions during driving may be minimized by keeping visual message portions to a necessary minimum, thereby reducing the length of messages presented on a visual display during driving. At the same time, a more complete presentation of message data may be accomplished by audio output. Users may also be permitted to disable audio playback of non-critical messages to prevent unwanted audible distractions.

The invention may also be used to reduce driver distraction while ensuring that important information is successfully communicated by controlling the time or conditions under which targeted broadcast messages are communicated. Broadcast messages can be received at any particular time by a targeted vehicle, and output only when appropriate conditions are satisfied. This may also more effectively target information of interest to a vehicle operator, and prevent unwanted distractions from messages at inopportune times.

Having thus described a preferred embodiment of a method and system for facilitating communication between a vehicle and a remote location, it should be apparent to those skilled in the art that certain advantages of the within system have been achieved. It should also be appreciated that various modifications, adaptations, and alternative embodiments thereof may be made within the scope and spirit of the present invention. For example, the use of broadcast communication networks has been illustrated, but it should be apparent that many of the inventive concepts described above would be equally applicable to the use of other non-broadcast communication networks. The invention is defined by the following claims.

What is claimed is:

1. A method for targeted transmission of audio and visual broadcast messages to motor vehicle operators and the selective playback of the broadcast messages, the method comprising:

generating a message for transmitting to at least one specified vehicle, the message comprising data for visual display and for audible output, and at least one control code configured to define message portions, the message portions comprising a visual portion for visual display and an audible portion for audible output; and transmitting the message directed to the at least one specified vehicle via a wireless medium.

2. The method of claim 1, wherein the transmitting step further comprises transmitting the message associated with an identifier specifying the at least one specified vehicle.

3. The method of claim 1, further comprising associating an identifier with the message, the identifier identifying the at least one vehicle using an identification code that is unique to a single vehicle.

4. The method of claim 1, further comprising associating an identifier with the message, the identifier identifying the at least one vehicle comprising a defined group of vehicles.

5. The method of claim 4, wherein the associating step further comprises identifying the at least one vehicle using an identifier that is unique to a group of vehicles, the identifier having at least one attribute selected from the group consisting of: vehicle model, vehicle manufacturer, year of manufacture, customer name, dealer name, purchase date, registration date and lease period.

6. The method of claim 1, wherein the transmitting step further comprises transmitting the message to a plurality of vehicles using a one-to-many broadcast system.

7. The method of claim 1, further comprising converting the message to a broadcast format prior to the transmitting step.

8. The method of claim 1, further comprising determining a time for transmitting the message to the at least one specified vehicle prior to the transmitting step.

9. The method of claim 1, wherein the generating step further comprises generating the message, wherein the audible portion of the message contains additional information that is not included in the visual portion.

10. The method of claim 1, wherein the generating step further comprises generating the message, wherein the message comprises a string of text data defined as the audible portion and the control code defines a portion of the text string as the visual portion.

11. The method of claim 1, wherein the generating step further comprises generating the message, wherein the visual portion comprises a code identifying predetermined information for visual display to be retrieved from a memory of the at least one specified vehicle.

12. The method of claim 1, wherein the generating step further comprises generating the message, wherein the audible portion comprises a code identifying predetermined information for audible output to be retrieved from a memory of the at least one specified vehicle.

13. The method of claim 1, wherein the generating step further comprises generating the message comprising a command for enabling a voice activation control in the at least one specified vehicle, the voice activation control operable to enable and disable output of the audible portion in response to a user input.

14. The method of claim 1, wherein the generating step further comprises generating the message comprising a command for causing the audible portion of the message to be automatically output in the at least one specified vehicle.

15. A system for targeted transmission of audio and visual broadcast messages to vehicle operators and the selective playback of the broadcast messages, the system comprising:

a motor vehicle;

a receiver associated with the motor vehicle; and a computer disposed to receive input from the receiver; and a memory operably associated with the computer, the memory holding program instructions for:

receiving a message from the receiver; and processing a message to determine data for visual display and for audible output based at least one control code of the message, the at least one control code configured to define message portions comprising a visual portion for visual display and an audible portion for audible output.

16. The system of claim 15, wherein the program instructions further comprise instructions for outputting the visual portion of the message for visual output in the motor vehicle.

17. The system of claim 16, wherein the program instructions comprise instructions for outputting the audible portion of the message for audible output in the motor vehicle.

18. The system of claim 15, wherein the program instructions further comprise instructions for determining whether the message is to be output in the motor vehicle, based on comparing a message identifier with a vehicle identifier stored in a memory associated with the motor vehicle.

19. The system of claim 15, further comprising at least one data source operably connected to the computer, the at least one data source selected from the group consisting of: a clock, an odometer, a fluid level gauge, a fluid pressure gauge, a speedometer, a temperature sensor and a GPS receiver.

20. The system of claim 19, wherein the program instructions further comprise instructions for determining whether or not the message is to be output in the motor vehicle, based on a vehicle state determined from the least one data source of the motor vehicle.

21. The system of claim 19, wherein the program instructions further comprise instructions for determining a time for outputting the message in the motor vehicle, based on a vehicle state determined from the least one data source of the motor vehicle.

22. The system of claim 15, further comprising a user input device operably connected to the computer, and wherein the program instructions further comprise instructions for determining whether at least the audible portion of the message is to be output in the motor vehicle, based on an input from the user input device.

23. The system of claim 15, wherein the program instructions further comprise instructions for selecting visual data for retrieving from a memory associated with the motor vehicle, based on a visual data identifier in the message.

24. The system of claim 15, wherein the program instructions further comprise instructions for selecting audible data for retrieving from a memory associated with the motor vehicle, based on an audible data identifier in the message.

* * * * *